United States Patent [19]

Gurewitz

[11] Patent Number: 4,720,040

[45] Date of Patent: Jan. 19, 1988

[54] SECURITY DEPOSIT BAG

[76] Inventor: Richard M. Gurewitz, 5914 Woodland View Dr., Woodland Hills, Calif. 91367

[21] Appl. No.: 943,425

[22] Filed: Dec. 19, 1986

[51] Int. Cl.[4] ..... B65D 33/14

[52] U.S. Cl. ..... 232/1 D; 383/5

[58] Field of Search ..... 232/1 D; 383/5, 52, 383/38, 84, 41, 106

[56] References Cited

U.S. PATENT DOCUMENTS

| | | | |
|---|---|---|---|
| 684,181 | 10/1901 | Briery . | |
| 1,881,890 | 10/1932 | Offenbacher . | |
| 2,374,115 | 4/1945 | MacDonald | 150/37 |
| 2,535,537 | 12/1950 | Heywood | 229/80 |
| 2,622,648 | 12/1952 | Ingram | 150/28 |
| 3,015,918 | 1/1962 | Schoen | 383/41 X |
| 3,070,278 | 12/1962 | Korn | 383/106 X |
| 3,720,305 | 3/1973 | Barton | 206/47 R |
| 3,844,409 | 10/1974 | Bodolay et al. | 383/38 X |
| 3,933,304 | 1/1976 | Judd | 383/5 |
| 4,464,158 | 8/1984 | Kardon | 493/265 |
| 4,483,018 | 11/1984 | Whelan | 383/5 |
| 4,509,196 | 4/1985 | Sak et al. | 383/5 |

FOREIGN PATENT DOCUMENTS

| | | |
|---|---|---|
| 1025034 | 6/1964 | United Kingdom . |
| 2032882 | 8/1979 | United Kingdom . |
| 2145997 | 9/1983 | United Kingdom . |
| 2149381 | 11/1983 | United Kingdom . |
| 2167381 | 11/1985 | United Kingdom . |

*Primary Examiner*—Robert W. Gibson, Jr.
*Attorney, Agent, or Firm*—Harlan P. Huebner

[57] ABSTRACT

A security deposit bag for negotiable instruments which preferable includes a section to receive a single form of negotiable instrument and a deposit slip for that form of negotiable instrument in which the bag is tamper proof and if unlawfully opened the same may be visually detected upon inspection. The bag may also have two sections wherein negotiable instruments of two different forms may be inserted such as cash and checks.

10 Claims, 10 Drawing Figures

FIG. 6.
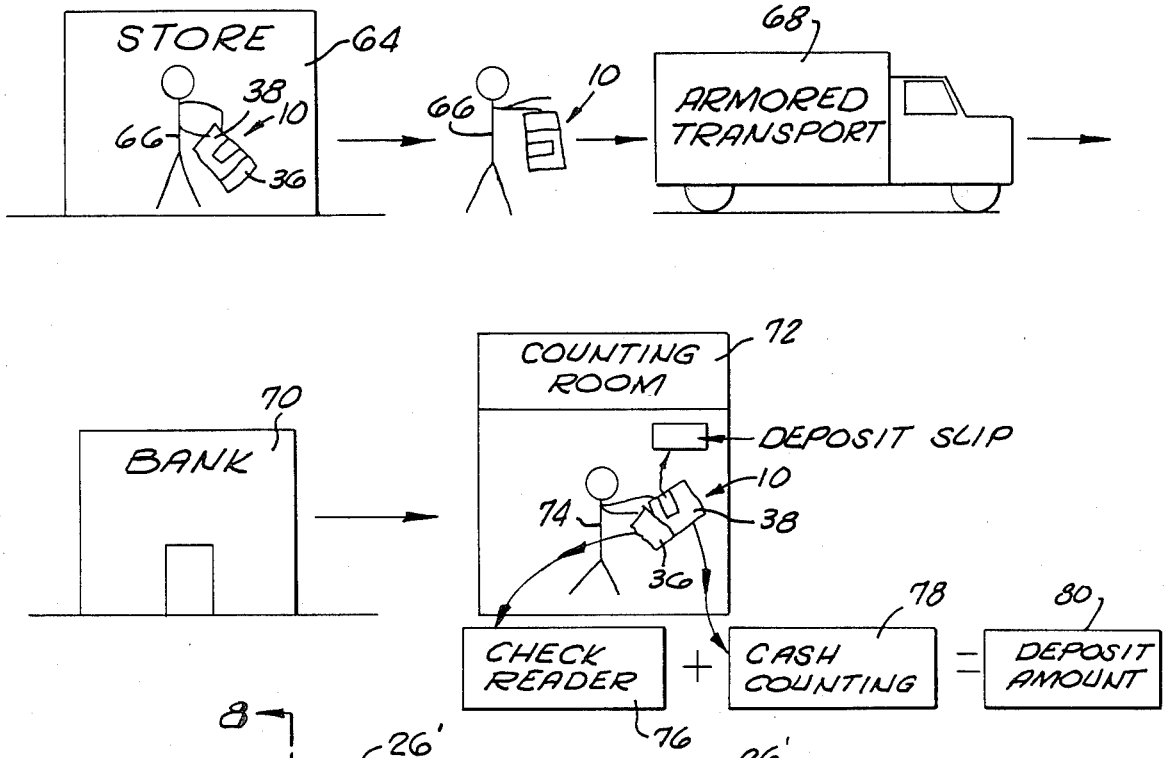
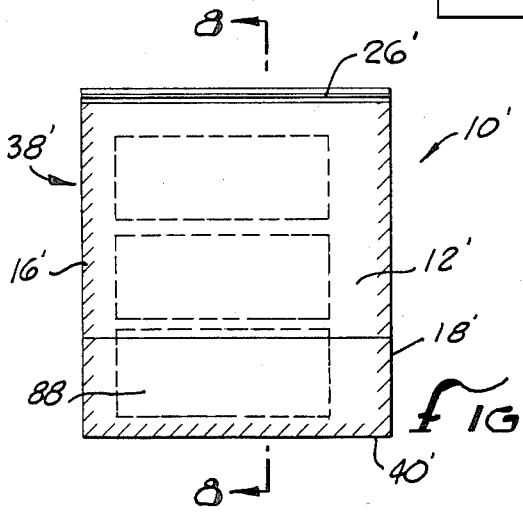
FIG. 7.
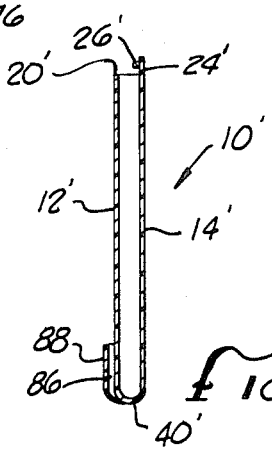
FIG. 8.
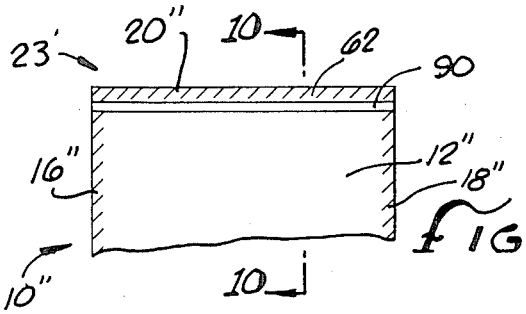
FIG. 9.
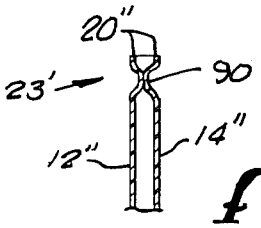
FIG. 10.

SECURITY DEPOSIT BAG

BACKGROUND OF THE INVENTION

1. Field of the Invention

This invention relates to a security deposit bag for negotiable instruments such as cash and checks.

2. Description of the Prior Art

There has always been a problem with theft and or shortages of negotiable instruments with the transportation of cash and checks from retail establishments to banks. Also, there has also been a problem of theft, lost or shortages of currency when cash from a bank is being transmitted to a retail establishment. In previous bags or containers there never has been adequate separation of negotiable instruments.

Present day cash and security bags are canvas with inadequate locking or sealing means. In addition, the cash and checks are usually all placed in the same bag. Thus, when it is necessary to separate the cash and checks for electronic check counting the seal is broken and the cash would be available for illegal removal and being open looses its integrity.

With the advent of a large number of people handling cash from the time money is placed in a cash register until its final counting by bank personnel the chances of theft, and loss are increased.

In addition, with present methods of storing and transporting cash and checks there is the possibility of cash disappearing between the store and bank so that the final tally differs from the store count. This then raises questions as to who is to blame and can result in insurance problems as to who is at fault or upon whom does the liability rest.

As an example of the usual steps taken to move money, a clerk receives money and it is placed in a cash register. From the register someone takes the money to an office or other area where it is counted and placed in some sort of bag or envelope. The counted cash then is picked up by an armored transport service and taken to a bank. At the bank the bag of money and the enclosed deposit slip is handled by a variety of tellers and bank personnel before a final count is made. It is evident that during any of the above steps there is an opportunity to steal the money or it may in some fashion become lost or misplaced. Particularly is this true when cash and checks are intermingled in a single bag for deposit.

Also, when a bank transfers money to a retain store for making change there is always the possibility of theft or a miscount. This then raises the question as to who is responsible, the bank, the transport company or the retail store, all had access to the present types of currency bags.

SUMMARY OF THE INVENTION

It is an object of the present invention to provide a negotiable instrument security deposit bag that may have the provision of two separate compartments in a single bag for the reception of cash in one and checks in the other.

It is a further object to provide that the compartments of the security deposit bag may be separated at a bank for appropriate processing of the cash and checks without compromising the security of the contents in either compartment until it is desired to do so.

Another object is to provide a security deposit bag that is transparent so that the contents may be visually inspected prior to opening the compartments.

A still further object is to provide sealing means for each compartment of a security deposit bag that is tamper evident proof and any attempt to open the bag or compartments will result in a tearing and mutilation of the bag.

Another object is to provide a security deposit bag that includes peripheral code marks to thwart tampering or unauthorized entry by cutting the edges and resealing the same.

Another object is to provide a security deposit bag with a pocket to receive a deposit slip which is separate from the compartments and the slip may be removed without distributing the security of the negotiable instruments therein.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which:

FIG. 6 is a step drawing illustrating the movement of negotiable instruments such as cash and checks from a retail establishment to a bank for final counting and depositing;

FIG. 7 is a modified security bag containing only one compartment;

FIG. 8 is a cross-sectional view taken on line 8—8 of FIG. 7;

FIG. 9 is a front elevational view of modified sealing means for the security bag; and FIG. 10 is a cross-sectional view taken on line 10—10 of FIG. 9.

DETAILED DESCRIPTION OF THE PREFERRED EMBODIMENT

Figure 1:
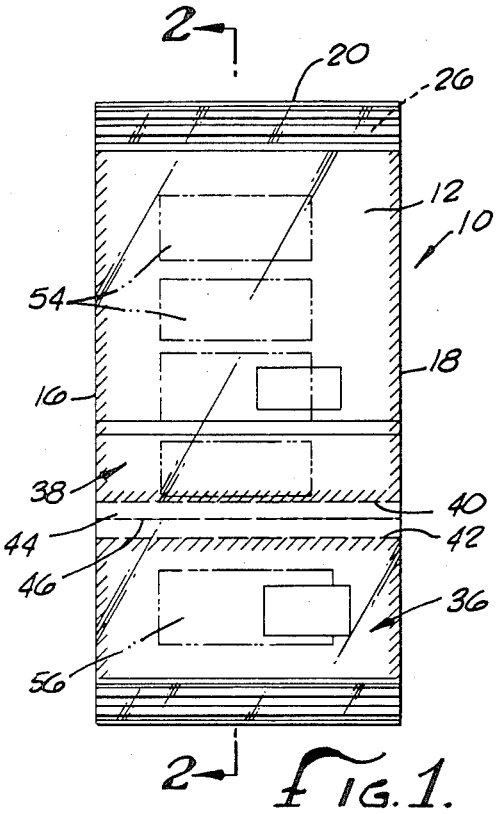
FIG. 1 is a front elevational view of the negotiable instruments security deposit bag of the present invention.

In FIG. 1 there is illustrated a security deposit bag for negotiable instruments generally designated 10. The deposit bag 10 is preferably formed of a pair of clear plastic rectangular sheets 12 and 14 such as 2 mil polyethlene where one is superimposed on the other. The bag 10 has side marginal edges 16 and 18 and end marginal edges 20 and 22.

The deposit bag 10 is secured along the side marginal edges 16 and 18 by heat sealing or other means such as an adhesive so that an envelope is formed.

At the end 20 the sheet 14 includes an end extension flap 24 which includes a ribbon of adhesive 26 which extends across the width of the plastic from edge 16 to edge 18. The adhesive 26 is of the pressure sensitive type that is generally regarded as permanent so that any attempt to open the flap 24 when sealed to the outside of the sheet 12 will tear the same and show that tempering has taken place in the case of an unlawful attempt to gain access. The adhesive 26 has a protective strip 28 that may be peeled off when the bag 10 at end 20 is to be closed or sealed.

At the opposite end 22 the sheet 14 also includes an end extension flap 30 which includes a ribbon of adhesive 32 which extends across the width of the plastic from edge 16 to edge 18. The adhesive 32 has a protective strip 34 that may be peeled off when the bag 10 at end 22 is to be closed or sealed.

It is preferable that the bag 10 be also formed into two sections or pockets generally designated 36 and 38. The section 36 is for the reception of checks and section 38 is for the reception of cash. The sections 36 and 38 are one above the other or they could be side by side and thus are in line.

In order to form the sections 36 and 38 the sheets 12 and 14 are heat sealed or otherwise secured at edges 40 and 42 respectively. The heat sealing extends across the width from edge 16 to 18 and are spaced from each other leaving a flat bridge portion 44 therebetween, see FIGS. 1, 4 and 5.

By sealing the sheets 12 and 14 at edges 40 and 42 there is created the two sections or pockets 36 and 38 for the checks and cash respectively.

Figure 2:
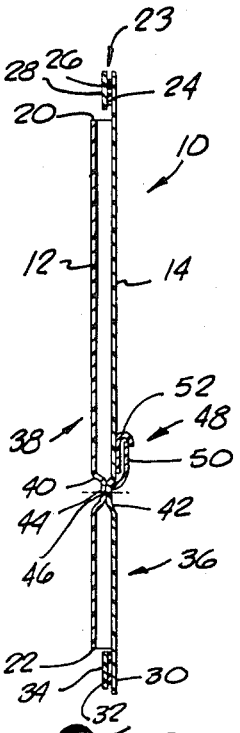
FIG. 2 is a cross-sectional view taken on line 2—2 of FIG. 1 showing the bag compartments in open position.
Figure 3:
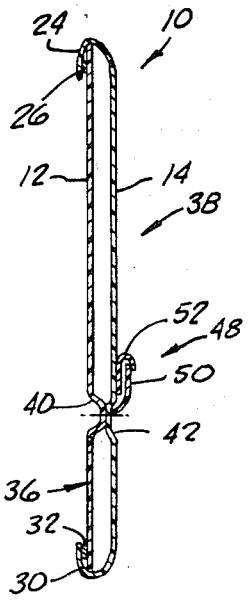
FIG. 3 is a cross-sectional view as in FIG. 2 but showing the bag compartments sealed.
Figure 4:
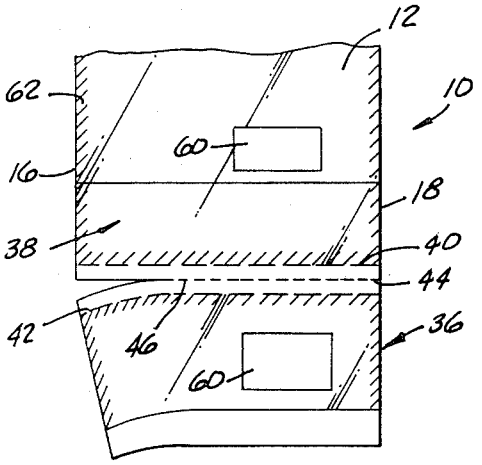
FIG. 4 is a partial front view of a part of the bag of the present invention illustrating how the compartments may be separated.

One of the important elements of the invention is to make the two pockets 36 and 38 separable, as illustrated in FIG. 4. In order to accomplish this the bridge portion 44 includes separation means and is perforated with a perforation line 46 that extends laterally across the deposit bag 10 from edge 16 to 18. The purpose of the perforation 46 will become apparent. As can best be seen in FIGS. 2 and 3 there is preferably formed a deposit slip pocket 48 on either sheet 12 or 14 that includes a front sheet 50 of clear plastic that can extend laterally on the bag 10 for any distance desired. Further there is also provided a top cover flap 52 which is secured to the sheet 12 or 14 and when a depsoit slip of the cash 54 (seen in phantom lines) is inserted therein the top 52 will close over the front sheet 50 and maintain the slip therein.

In addition a similar deposit pocket as explained above may be employed for a check pocket 36. However, in most cases the check deposit slip is put in with the checks 56 (shown in phantom lines) and there is no need for a special exterior pocket.

Figure 5:
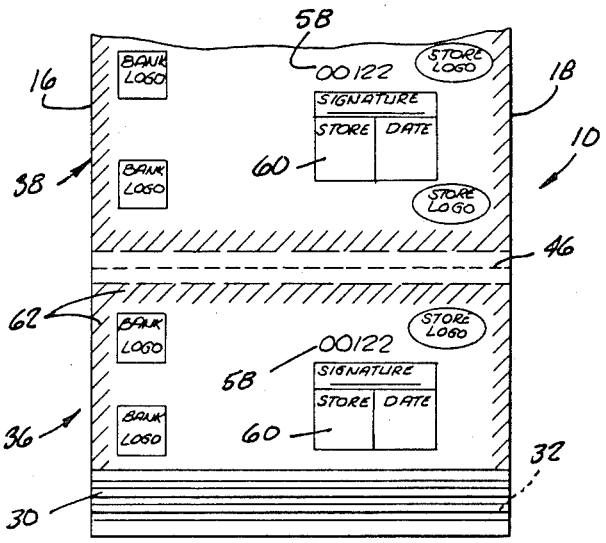
FIG. 5 is an enlarged partial view of the security bag with code indicia to prevent tampering and where other spaces to receive information might be positioned.

Preferably the deposit bag 10 includes printing in the form of a bag number 58, see FIG. 5 which is duplicated on each pocket 36 and 38 of the bag 10 for positive identification. In addition, there is usually printed on both pockets 36 and 38 a white or light colored information block 60 that can be written on to record appropriate data. Particularly is this helpful when the bag 10 is separated into the two separate pockets 36 and 38.

As an added precaution against tampering the marginal edges 16, 18 and the heat sealed edges 40 and 42 may be provided with printed code markings 62. Such markings 62 are on both sides of the bag 10 so that should someone endeavor to unlawfully open the edges such as 16 or 18, remove the cash 54 and reseal the same misalignment of the marks or shortening of the length thereof will show improper tampering. In addition, it is preferable to utilize markings 62 adjacent the performation 46 as a further security measure.

In FIG. 6 there is illustrated a step diagram which is generally used by a retailer and the ensuing travels of cash 54 and checks 56 to be deposited.

At the store 64 an employee 66 will utilize the security deposit bag 10 as follows. The employee 66 will enter all of the checks 56 on an appropriate check deposit slip, also the employee will enter the bag member on the slip for further security, endorse the checks and place the checks and check deposit slip in the pocket 38, remove the protective strip 34 and seal the end as seen in FIG. 3.

The employee 66 will then count the cash 54 and enter the amount on an appropriate cash deposit slip. The cash may be placed in different color envelopes for different denominations or days of the week or just bundled in the same denominations. The cash 54 is then inserted in the pocket or section 38 either with or without the deposit slip and the end 20 is sealed by the flap 24 and adhesive 26. The cash deposit slip may then be inserted in the deposit slip pocket 48. After the cash and checks are placed in the bag 10 appropriate indicia can be entered in the information block 50.

The employee 66 then gives the security deposit bag 10 to the employee of an armored transport 68 for transportation of the bag to the bank 70.

The bag 10 with its negotiable instruments is then delivered to the counting area 72 of the bank. At that time the bank employee 74 can check to see if the security deposit bag 10 has been tampered with. Also, the bank employee 74 will tear the bag 10 along the perforations 46 so that the checks 56 may be immediately credited to the customers account and then forwarded in the check section 36 to the conventional automatic check counting reader 76.

The cash section 38 of bag 10 can be stored or forwarded to the cash counting area 78 where for the first time the section 38 is opened, the cash counted and reconciled with the cash deposit slip.

The cash and checks can then be added up to see if they correspond to the total deposit 80.

As can be seen, at any stage of the procedure it can be determined if the security deposit bag had been tampered with should the cash and or checks not tally with the deposit amount 80. In this way each step can be checked to determine at what point unlawful entry may have occured. A form of systematic review can be used to check each step of the transaction.

FIGS. 7 and 8 illustrates a modified security deposit bag 10'. This bag 10' includes sheets 12' and 14' which are sealed along side marginal edges 16' and 18'. The upper end 20' includes a sealing flap extension 24' and adhesive 26' to close the end.

The difference resides in the fact that there are not two sections but only a cash or other substance section 38' which is sealed at 40'. Also, there is a cash or notation pocket 86 formed of a clear plastic front sheet 88 extending up the sheet 12' and across the width as far as necessary.

This modified bag 10' is for cash or other substances only and may be used where only cash is deposited, where a bank by reverse steps than in FIG. 6 are sending a retail store cash for its use or other substances are being transported for some other purpose.

FIGS. 9 and 10 illustrate modified end closure means 23' wherein instead of an end extension 24 and adhesive 26, the sheets 12" and 14" are heat sealed at 90 and the seal extends across the bag from edge 16" to 18".

Further, the inventor provides additional code markings 62 along edges 20. Thus should anyone cut the bag 10 below the heat sealed area 90 and attempt to reseal the same, the code markings 62 are no longer present and visually it can be determined that the bag 10'' has been tampered with.

The heat seal 90 may be used for one edge 20'' and/or the bottom edge 22 as well.

While the bag 10 has been described as formed of two marginal edges 16 and 18 the bag 10 may be a single piece of plastic where either or both edges 16 and 18 do not have to be fused together without departing from the spirit of the invention.

While the invention has been defined in the terms of a bag for use with negotiable instruments it must be realized that being tamper evident proof other substances can be placed in the bag without departing from the spirit of the invention.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A security deposit bag for negotiable instruments to store and transport said negotiable instruments and to by visual inspection determine whether said bag has been tampered with, said bag comprising:

a pair of superimposed plastic sheets having ends sealed along opposed marginal edges and along a bridge area extending therebetween forming a pair of in line negotiable instrument pockets therein each adapted to receive a single form of negotiable instrument, and end extension flaps opposite said bridge area extending from the respective ends of one of said plastic sheets:

sealing means on said end extension flaps to secure said end extension flaps with the other of said plastic sheet to permanently close said negotiable instrument pockets, whereby an attempt to open said sealed end will result in a tearing of said bag; and separation means on said bridge area to be used to separate said in line pockets one from the other for appropriate servicing by a financial institution.

2. A security deposit bag as defined in claim 1 wherein:

said sealing means is a pressure sensitive adhesive wherein a bond is setup that will not allow separation of the plastic sheets without tearing the same.

3. A security deposit bag as defined in claim 1 wherein:

said pockets have end seals extending between said opposed marginal edges defining opposed sides of said bridge, and each of said pockets opposite said end seals include extension flaps with adhesive thereon and are capable of closing each of said pockets with negotiable instruments therein.

4. A security deposit bag as defined in claim 1 wherein on the exterior of said bag a deposit slip pocket is formed for use in counting the particular negotiable instrument therein.

5. A security deposit bag as defined in claim 1 wherein said opposed marginal edges include code markings on both of said sheets which will visually show any tampering with said edges in an endeavor to unlawfully gain access therein.

6. A security deposit bag as defined in claim 1 wherein the plastic is a low density 2 mil polyethylene which is clear whereby visual inspection of the contents therein may be made.

7. A security deposit bag for cash and checks to store and transport said cash and checks and to by visual inspection determine whether said bag has been tampered with, said bag comprising:

a rectangular shaped envelope having opposed side marginal edges and opposed ends; and a pair of opposed ended marginal edges at each end extending between said opposed side marginal edges;

an extension flap extending from each of said end marginal edges adapted to be folded and close each end of said rectangular envelope and including a pressure sensitive adhesive to close each flap;

a pair of heat sealed pocket edges each generally parallel one with the other extending between said side marginal edges, and said pocket edges are intermediate the end marginal edges forming a cash pocket and a check pocket;

a bridge between said pockets; and perforation means in said bridge adapted to be torn separating one pocket from the other for appropriate bank servicing of said cash and said checks.

8. A security deposit bag a defined in claim 7 wherein said bag is formed of clear plastic whereby visual inspection of the contents therein may be made.

9. A security deposit bag as defined in claim 7 wherein said pressure sensitive adhesive is permanent whereby said extension flaps cannot be opened without tearing said flaps and said rectangular envelope.

10. A security deposit bag as defined in claim 7 wherein:

at least one deposit slip pocket is provided on the exterior of said bag.

* * * * *